United States Patent [19]

Schmidt

[11] 4,305,016

[45] Dec. 8, 1981

[54] ELECTRIC LAMP WITH OPAQUE CAP, PARTICULARLY HALOGEN CYCLE, DUAL FILAMENT, AUTOMOTIVE-TYPE LAMP

[75] Inventor: Gerhard Schmidt, Herbrechtingen, Fed. Rep. of Germany

[73] Assignee: Patent-Treuhand-Gesellschaft für elektrische Glühlampen mbH, Munich, Fed. Rep. of Germany

[21] Appl. No.: 63,413

[22] Filed: Aug. 3, 1979

[30] Foreign Application Priority Data

Aug. 25, 1978 [DE] Fed. Rep. of Germany ..... 2837280

[51] Int. Cl.[3] ..... H01J 5/16; H01J 61/40

[52] U.S. Cl. ..... 313/117; 427/106

[58] Field of Search ..... 313/117, 489; 427/106

[56] References Cited

U.S. PATENT DOCUMENTS 3,784,861 1/1974 Notelteirs et al. ..... 313/117

FOREIGN PATENT DOCUMENTS 1334329 10/1973 United Kingdom .

*Primary Examiner*—Robert Segal

*Attorney, Agent, or Firm*—Frishauf, Holtz, Goodman & Woodward

[57] ABSTRACT

An electric lamp, particularly a halogen cycle lamp, adapted to be used as a dual filament automotive lamp which has an opaque end cap coated on the hard glass bulb. The end cap coating comprises a mixture of carbonyl iron powder and silicon powder, preferably in a ratio of between 1.5:1 and 4:1 (by weight) and more preferably in a ratio of about 2:1. The lamps have the important advantages of excellent utility during service coupled with the ability to be manufactured at relatively low burning in temperatures, i.e. in the order of about 530° C.

3 Claims, 1 Drawing Figure

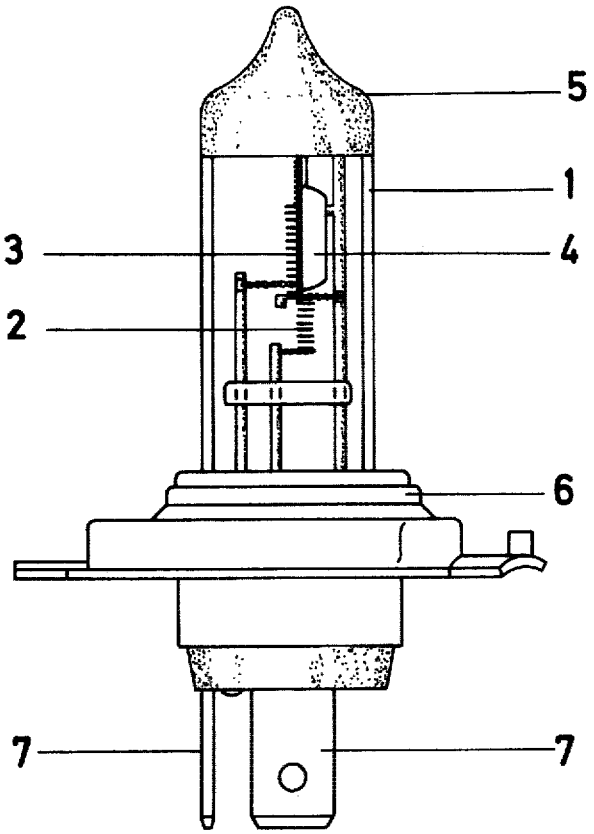
5
1
3
4
2
6
7
7

ELECTRIC LAMP WITH OPAQUE CAP, PARTICULARLY HALOGEN CYCLE, DUAL FILAMENT, AUTOMOTIVE-TYPE LAMP

The present invention relates to an electric lamp, and more particularly to a halogen cycle, dual filament lamp for automotive use with an opaque cap at one end of the light bulb.

BACKGROUND AND PRIOR ART

Various types of automotive lamps are partially covered with an opaque coating in order to prevent undesired stray radiation from the lamp which is not properly focused by the reflector in which it is to be mounted. It has previously been proposed to make such a cap of a mixture of carbonyl iron powder and cobalt (II, IV)—oxide—$CO_3O_4$. The ratio of carbonyl iron powder to cobalt oxide can be in the order of between 1.5:1 to 4:1. In a usually used form, the ratio is between 5:3 to 11:6. The pigment is suspended in a vehicle, such as butanol, the bulb is dipped into the suspension of pigment and butanol, and after pulling out the bulb it is dried. The coating remaining on the bulb is then heated and sintered to a final temperature in the order of about 800° C. This applies the coating to the lamp bulb. Prior to dipping, the end or cap portion of the bulb is heated to about 700° C. in an oxidizing atmosphere to clean the cap of the bulb (see, for example British Patent Specification 1,334,329, German Disclosure Document DE-OS No. 21 36 012 and British Patent Specification 1,334,329 which contains similar disclosure).

THE INVENTION

It is an object to improve opaque coatings at the end of light bulbs which have a lesser tendency to flake off, require a lower temperature for processing, and have improved stability.

Briefly, in accordance with the invention, the opaque coating is made of a mixture of carbonyl iron powder and silicon powder. The ratio of carbonyl iron powder to silicon powder can be in the order of 1.5:1 to 4:1, (by weight) with a ratio of about 2:1 being particularly preferred. The temperature at which this coating is burned in is much less-in the order of about 530° C. The stability of the coating is better. It is believed that the improvement in the stability is due to the lack of contaminants which are usually present in cobalt oxide and which interfere with stability of the coating.

Drawing, illustrating an automotive, dual filament, halogen cycle lamp, in a highly schematic side view, and to an enlarged scale:

The lamp bulb 1 consists of a high melting glass, such as quartz glass, a glass similar to quartz glass and known under the trademark "VYCOR", or a hard glass suitable for halogen cycle lamps such as, for example, the glass known in the industry as OSRAM 943. Two filaments which can be selectively energized are located within the interior of the bulb, consisting of helically twisted tungsten wires. One filament is for high beam, shown as filament 2, and one for low beam, or depressed beam, shown as filament 3. A shielding cap 4 made of molydenum is likewise included in the bulb 1. The bulb 1 is filled with inert gases with an addition of one or more halogens in a quantity which ensures proper operation of the well-known tungsten-halogen cycle. A light shielding, opaque coating 5 is applied to the end cap of the lamp. The lamp has a socket 6 with connection terminals 7. The lamp structure itself, the components within the bulb, and the arrangement is well known and corresponds to any one of commercial automotive-type dual filament halogen cycle lamps. The present invention is directed to the composition of the coating 5, and to a method of its manufacture.

The coating 5 consists of a mixture of carbonyl iron powder and powdered silicon. Pigment paste is made by placing the pigments into a ball mill and adding an organic liquid to grind the pigments and liquid together to form a suspension. The organic liquid, preferably, is butanol, which is the preferred carrier liquid for the suspension. Other materials can be used, for example, instead of butanol, organic liquids such as ethanol, methanol, or butylglycol. It is not necessary to additionally introduce an additive to increase the viscosity, such as for example nitrocellulose.

Example for method of making the pigment paste or suspension for the coating 5: A porcelain ball mill of 5 liter capacity has added thereto balls of about 25 mm or up to about 35 mm. The following then is added to the ball mill:

2.2 kg carbonyl iron powder
1.1 kg silicon powder
2.3 kg butanol.

The relationship between carbonyl iron powder and silicon powder, thus, is about 2:1 (by weight); the overall relationship of the mixture (by weight) is about 39% carbonyl iron powder, 20% silicon powder, and 41% butanol.

Grinding is carried out for about 150 hours, with a speed of 75 rpm. The pigment suspension is then drawn off and passed through a sieve with 60 μm mesh. The suspension is then ready for use.

The lamp bulb is heated to a temperature of about 110° C. and, by means of a mechanical dipping apparatus, the tip of the lamp bulb is dipped into the pigment paste for the appropriate depth, to form the cap 5. The suspension is continuously stirred in order to ensure continued uniformity of the suspension. The lamps are then pulled from the suspension and, excess suspension is dripped off, to permit the non-adhering excess to be removed. The butanol is entirely evaporated, for example by applying external heat by electrical heating elements. Thereafter, the remaining coating is burned in at a final temperature of about 530° C.

The coating thus made has a thickness of about 10 μm. Tests have shown that the coating can easily stand several thousand connections and disconnections of the filament without being subjected to localized flaking or chipping off, although the halogen lamps have a very high operating temperature and the thermal coefficient of expansion of the glass for the bulb, that is, quartz glass or other suitable hard glass, is substantially different from that of the coating 5.

I claim:

1. Automotive, dual filament, halogen cycle incandescent lamp comprising a halogen cycle lamp having an opaque coated-on end cap, having a glass bulb in which the glass of the bulb comprises a high melting glass to which the opaque coated-on end cap is applied, and the end cap coating comprises a mixture of carbonyl iron powder and silicon powder in a weight ration of about 2:1, and further comprising two separately selectively energizable filaments (2,3) located within the glass bulb, the glass material of the glass bulb comprising at least one glass selected from the group consisting of a quartz glass, a quartz-like glass and a hard glass.

2. Automotive lamp according to claim 1, wherein the coating has a thickness of about 0.01 mm.

3. Automotive lamp according to claim 2, wherein said glass bulb comprises a hard glass.

* * * * *